US009561445B2

(12) United States Patent
Cook

(10) Patent No.: US 9,561,445 B2
(45) Date of Patent: Feb. 7, 2017

(54) MECHANISM FOR CAUSING INVERTED-GYROSCOPIC PRECESSION

(71) Applicant: PEBBLEBROOK TOYS, INC., Maumee, OH (US)

(72) Inventor: Jeffrey N. Cook, Maumee, OH (US)

(73) Assignee: PEBBLEBROOK TOYS, INC., Maumee, OH (US)

( * ) Notice: Subject to any disclaimer, the term of this patent is extended or adjusted under 35 U.S.C. 154(b) by 0 days.

(21) Appl. No.: 14/721,238

(22) Filed: May 26, 2015

(65) Prior Publication Data

US 2015/0345945 A1 Dec. 3, 2015

Related U.S. Application Data

(60) Provisional application No. 61/997,264, filed on May 27, 2014.

(51) Int. Cl.

| | |
|---|---|
| ***G01C 19/16*** | (2006.01) |
| ***G01C 19/20*** | (2006.01) |
| ***G01C 19/38*** | (2006.01) |
| ***A63H 1/00*** | (2006.01) |

(52) U.S. Cl.
CPC . *A63H 1/00* (2013.01); *Y10T 74/12* (2015.01)

(58) Field of Classification Search
CPC ..... F16H 1/321; F16H 33/10; A63B 21/222; H02K 49/102
USPC ..... 74/64, 86, 87, 5.46, DIG. 4
See application file for complete search history.

(56) References Cited

U.S. PATENT DOCUMENTS

| | | | | |
|---|---|---|---|---|
| 2,167,641 | A * | 8/1939 | Dewan | G11B 15/26 310/103 |
| 2,916,919 | A * | 12/1959 | Echolds | G01C 19/38 74/5.4 |
| 2,960,793 | A * | 11/1960 | Van Cleave | A63B 21/0608 273/DIG. 17 |
| 2,963,912 | A * | 12/1960 | Kawarada | G01C 19/38 74/29 |
| 3,108,185 | A * | 10/1963 | Buerger | G01N 23/205 378/77 |
| 3,422,297 | A * | 1/1969 | Cotton De Bennetot | C23C 14/505 310/103 |
| 5,321,986 | A * | 6/1994 | Sears | G01C 19/30 74/5.46 |
| 2005/0028628 | A1* | 2/2005 | Liue | H02K 49/102 74/431 |
| 2011/0266902 | A1* | 11/2011 | Whitfield | B63H 23/22 310/103 |

(Continued)

*Primary Examiner* — William Kelleher
*Assistant Examiner* — Jake Cook
(74) *Attorney, Agent, or Firm* — Dennis L. Cook, Esq.

(57) ABSTRACT

A mechanism that relies on round magnets (or an alternative modification that imitates round magnets) and their property that when magnetically attached tangentally and parallel to their axis of symmetry they have the tendency to counter-rotate rotate freely when their structural containment is tilted or turned or either magnet is moved, and that they resist twisting on their respective axes such that when an Inner Magnet is arranged so that its rotational circumference is less than an Outer Magnet, and Mechanical Force is applied to either the Outer Magnet or the Inner Magnet, the system exhibits the inverted gyroscopic effect when the apparatus implements one or more features of Mechanical Give is disclosed.

2 Claims, 7 Drawing Sheets

*Example apparatus (top exposed)*

(56) References Cited

U.S. PATENT DOCUMENTS

2013/0104864 A1* 5/2013 Westmeyer ..... F41B 3/04
124/6

* cited by examiner

*Example apparatus (top exposed)*

*Polarity is Opposite*

*Magnets Counter-Rolling on a Plane*

*Magnet with Housing Suspended on Rod*

*The Four Rotations*

*Torsion of the two magnets on their axes*

*Prior Art Common gyroscope components*

*Velocity Vector Image on Inner Magnet defined in terms of the principles of angular momentum (right view)*

*Velocity Vector Image on Inner Magnet defined in terms of the principles of angular momentum (front-right view)*

*Velocity Vector Image on Inner Magnet defined in terms of the principles of angular momentum (front view)*

*Example of Mechanical Advantage by means of a CV Joint or Axle*

*Handheld rod exercise tool example*

*Analytical drawing of handheld rod exercise example*

*An alternative to magnets, using belts and bearings*

MECHANISM FOR CAUSING INVERTED-GYROSCOPIC PRECESSION

CROSS REFERENCE TO RELATED APPLICATION

The present Application claims the benefit of previously filed Provisional Patent Application, U.S. Ser. No. 61/997,264 filed May 27, 2014.

FIELD OF THE INVENTION

This invention belongs to the fields of magnetic and gyroscopic devices. More specifically rotational magnetic devices and inverted gyroscopes.

BACKGROUND OF THE INVENTION

A mechanism is disclosed that can be applied to the sports fitness, machinery, automotive, aerospace, oceanography, toy and hobby, electrical or other varied industries that causes an inverted gyroscopic effect. Magnets have been used in various rotational configurations and gyroscopes have been implemented in various inventions. All other similar prior art devices are known to Applicant, but does not use the unique configuration disclosed and claimed in this application.

The mechanism of this disclosure relies on round magnets (or an alternative modification that imitates round magnets) and their property that when magnetically attached tangentally and parallel to their axis of symmetry (in the direction of the polarity), as will be described so that their poles are pointed in opposite directions, they counter-rotate freely when their structural frame is tilted or turned or either magnet is moved, but resist twisting on their respective axes. When one of the magnets (referred to herein as the "Inner Magnet") is arranged so that its rotational circumference is less than another (the "Outer Magnet") and linear force (the "Mechanical Force") is applied to either the Outer Magnet or the Inner Magnet, the system will exhibit the inverted gyroscopic effect provided the apparatus implements some element of structural give between, around or outside the two magnets (the "Mechanical Give").

BRIEF SUMMARY OF THE INVENTION

The disclosed mechanism relies on round magnets (or an alternative modification that imitates round magnets) and their property that when magnetically attached tangentally and parallel to their axis of symmetry they have the tendency to counter-rotate rotate freely when their structural containment is tilted or turned or either magnet is moved, and that they resist twisting on their respective axes. When an Inner Magnet is arranged so that its rotational circumference is less than an Outer Magnet, and Mechanical Force is applied to either the Outer Magnet or the Inner Magnet, the system exhibits the inverted gyroscopic effect when the apparatus implements one or more features of Mechanical Give.

BRIEF DESCRIPTION OF THE DRAWINGS

For a fuller understanding of the nature and objects of the invention, reference should be made to the following detailed description, taken in connection with the accompanying drawings, in which.

DESCRIPTION OF THE PREFERRED EMBODIMENT

Figure 1:
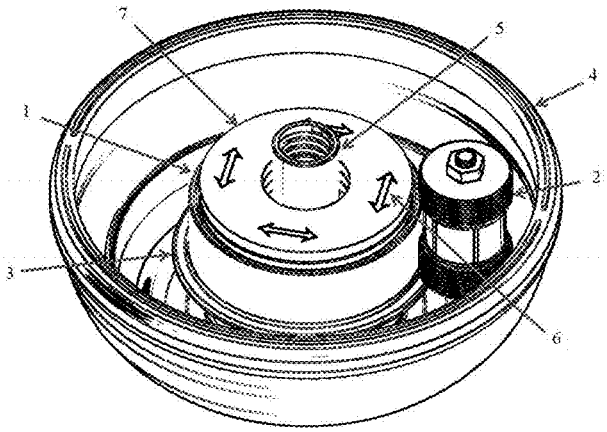
FIG. 1 shows one preferred embodiment of the apparatus.

The mechanism most simply consists of two or more magnets set in an arrangement that allows the various magnets to counter-rotate against each other or separated by a spacer in the same planar reference with poles facing in opposite directions as shown in FIG. 1. The parts are identified as follows: 1) Inner Magnet (ring magnet specifically) loosely laid in magnet housing with enough free space for precession, rotation and nutation (a feature of Mechanical Give), 2) weighted roller Outer Magnet assembly, connected only by magnetic force with enough clearance for twisting axially as well as rotationally (an additional feature of Mechanical Give), 3) magnet housing Spacer, 4) apparatus enclosure, 5) threaded coupler for enclosure, 6) optional arrows or other marking on rubber magnet shoe for visual reference and 7) optional rubber magnet shoe for Mechanical Give of the magnet as it precesses and also for deadening the sound during operation.

Magnets with near perfect circular perimeters may be considered ideal for many applications, but even magnets with course textures and/or tread or wear will also work with varying degrees of effectiveness, depending on the application.

Figure 2:
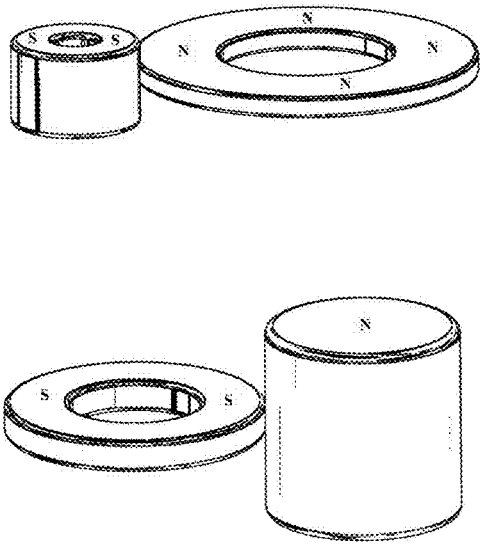
FIG. 2 shows magnet polarity.

The mechanism works whether or not the magnets have holes (ring magnets), and the magnets can be of limited various shapes so long as the poles reside on some face or surface of the magnets in such a way that the two are prevented from turning more than ninety degrees to pull together as shown in FIG. 2.

The mechanism can be understood by first considering a wheel with or without tread on a smooth, flat surface. If the surface is tilted just slightly, a wheel tends to roll by the force of gravity. But if the surface is smooth and/or slippery enough and the surface is tilted significantly, then the wheel may slip (or roll with some slippage). The determining factor of whether or not the wheel will roll or slip is determined by the friction $F_r$ (the "Resistive Force") at the "Instant Center of Rotation" u (the point at which the wheel touches the surface), as well as force $F_u$ (the "Attractive Force") holding the wheel to the surface.

Thus, a minimum amount of Resistive Force $F_{rmin}$ is required for this mechanism (but occurs naturally in most cases even when lubricated, as will be described), as well as a minimum amount of Attractive Force at the Instant Center of Rotation $F_{umin}$, but the minimum amount of Attractive Force at the Instant Center of Rotation $F_{umin}$ must be greater than the minimum amount of Resistive Force $F_{rmin}$, else slippage will occur.

Figure 3:
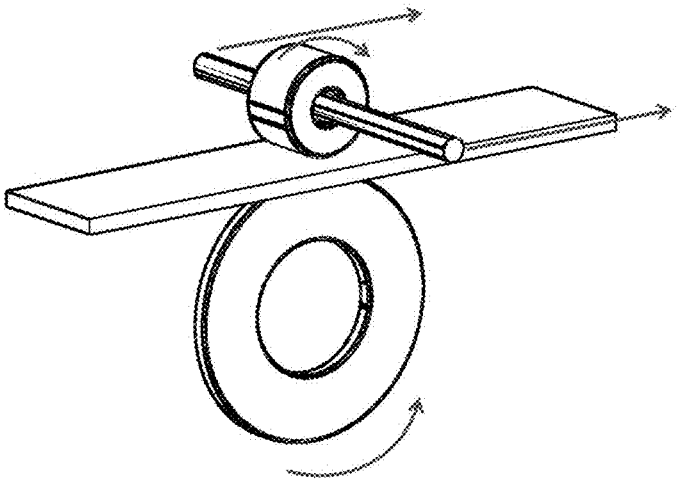
FIG. 3 shows magnet counter-rolling on a plane.

When a wheel is a polarized ferrous material (a permanent magnet or electromagnetic configuration) rolling on either the X, Y or Z plane (from an XYZ coordinate), whose poles are facing ninety degrees to any given plane from its line of travel, and another magnet with poles facing in opposite directions is separated by a surface ("the Spacer", for instance a thin but rigid sheet of brass, plastic or other non-ferrous material between the two magnets), the magnetic force holding the magnets to both sides of the Spacer becomes the Attractive Force $F_u$ as shown in FIG. 3.

When a non-rigid material is used as a Spacer with a strong permanent magnet (that of a thin piece of paper for instance), it tends to buckle under the force, which restricts the magnet's travel; thus, a rigid Spacer is preferred.

However, if the non-ferrous Spacer is rigid, and either one of the magnets is rolled along one side of the Spacer, the other counter-rotates on its axis on the other side so that both are rolling forward toward their direction of travel.

If only one of the magnets is prevented from rolling, but still permitted to slide (touching the Spacer or simply near it), the other will continue to roll forward in the direction of its travel despite the fact that the other is fixed.

These effects do not occur in the same way with only one said-polarized ferrous wheel with a strong resistance to demagnetization and another with very weak resistance to demagnetization (for instance an iron, nickel or zinc wheel), as the poles of the latter re-orient under the influence of the stronger, which significantly restricts any ability to roll. In other words, a ring magnet and a steel washer having the same or similar geometric dimensions will not permit the following mechanism to result.

When two polarized magnets, however, are arranged in such a way that their poles are facing opposite to each other, then the only resistance preventing them from rolling against each other's circumference is the smoothness of the materials used and/or the uniform roundness of the materials.

The mechanism works well with a Spacer or without a Spacer, but a Spacer may be beneficial in many applications in order to prevent chipping and/or scratching of the magnets themselves and can be used to allow for or even implement the Mechanical Give that is required for the mechanism, as will be described.

Because the Attractive Force holding the two or more magnets together drops off with the square of distance, a thinner Spacer may be more ideal for some applications.

The magnet thickness (the distance between the poles of the magnet through its own structure) implemented should be wide enough so that the magnets do not tend to fall flat against the Spacer or the opposite magnet, thereby preventing either magnet from rolling.

Suspending two or more ring magnets whose poles are exactly opposite respectively on a rod (or by any other various means: two or more separate rods for instance) so that no solid material separates the two (an air or free space Spacer for instance) does not permit rotation, as $F_{umin}=0$ in such a configuration. This occurs when two or more magnets' poles are exactly parallel and exactly opposite to each other respectively.

However, various configurations are possible for certain applications where two or more magnets are required to be suspended and separated by a non-solid material by utilizing magnetic housings that fix the two or more angles of the magnets.

Figure 4:
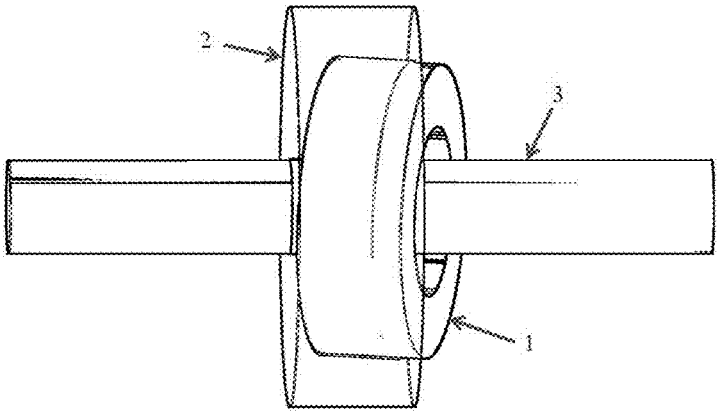
FIG. 4 shows a ring magnet with housing suspended on a rod.

The preferred embodiment for such a configuration whereby a rod lies on the X plane and the magnet housing freely rotates on the rod, the magnet then should be angled both on the Y plane and also the Z plane as shown in FIG. 4 where the parts are identified as follows: 1) Ring Magnet, 2) Magnet Housing whose inside fixes Ring Magnet at preferred angles, but whose outside is parallel to 3) the Rod.

Said arrangement allows for a right-handed counter-rotation or a left-handed counter-rotation, especially when the angle of the Y plane is greater or less than that of the Z plane.

In this arrangement, the magnet is made to precess and rotate, but the housing (and anything attached to it) is only rotating around the fixed rod.

In this way, instead of Resistive Force $F_r$ being due to friction, the angled magnet in and of itself allows a slight difference in polarity by exposing both poles at each rotation, thus a minimum amount of Attractive Force $F_{umin}$ becomes present, as well as a minimum amount of Resistive Force $F_{rmin}$.

Thus, by rotating one of the magnets, the other counter-rotates with only free space between them as if they were separated by a solid Spacer.

Due to a more complex description for suspended ring magnets with an air or free space Spacer, the mechanism will further be described only in terms of a solid Spacer where the poles of the two or more counter-rotating magnets is induced by friction, so long as it is understood that when both $F_{umin}, F_{rmin}>0$ the mechanism is the same.

Figure 5:
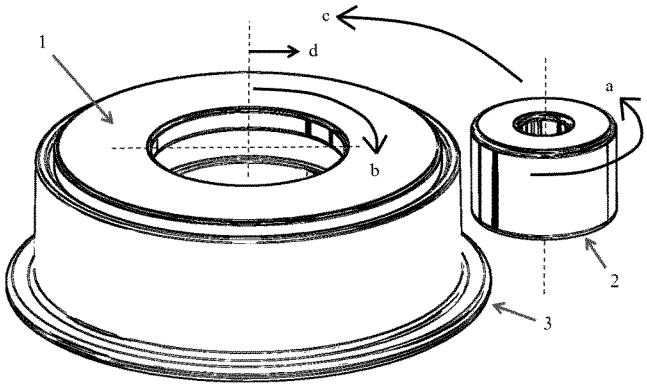
FIG. 5 shows magnet orbit and rotations.

Provided the above required conditions are met, when the Spacer is curved, forming a hollow cylinder, the direction of the path of travel alone manifests two additional rotations for each additional magnet, a total of four when considering just two magnets: 1) rotation of the Outer Magnet on its axis of symmetry (the "Outer Magnet Axial Rotation"), 2) rotation of the Inner Magnet on its axis of symmetry (the "Inner Magnet Axial Rotation"), 3) rotation of the Outer Magnet around the outside of the cylinder Spacer (the "Outer Orbit") and 4) rotation of the Inner Magnet around the inside of the cylinder Spacer (the "Inner Orbit") as shown in FIG. 5 where the parts are identified as 1) Inner Magnet, 2) Outer Magnet, 3) Spacer, a) Outer Magnet Axial Rotation, b) Inner Magnet Axial Rotation, c) Outer Magnet Orbit and with enough clearance d) Inner Magnet Orbit.

The following descriptions of the mechanism are limited in terms of two magnets for the remainder of this patent application, so long as it is understood that configurations may be implemented to allow for more for varied results and features.

When Mechanical Force $F_a$ is applied to either the Inner Magnet or Outer Magnet in one direction tangent to the cylinder Spacer's circumference all four rotations occur near instantaneously (as instantaneously as magnetic fields interact).

The length of time the rotations continue after a given Mechanical Force is applied and ceased is dependent upon the amount of force applied and how well the magnets roll based on the previously discussed conditions.

When $F_a>F_u$ the Outer Magnet will tend to detach from the cylinder Spacer.

When the Spacer is a cylinder, the angular momentum induced by $F_a$ causes force $F_r$ to increase, as the Outer Magnet is pulled tangently away from the center of the configuration and the Inner Magnet is pulled against the inside of the cylinder Spacer, in return pulling back on the Outer Magnet. Said behavior is required in order to induce the rotations.

Said increase of $F_r$ is proportionate to a factor of the ratio between the radius of the cylinder Spacer and the radius of the Inner magnet (the "Radial Factor" $D_r$).

If the difference between the radius of the cylinder Spacer and the radius of the Inner magnet is slight (for instance roughly 1/32" or less) then $F_r$ will not increase notably and the Outer Magnet will continue to roll more freely after Mechanical Force is applied and ceased than if the difference between the two radii is greater.

However, if the radius difference is non-existent, then the Radial Factor too reduces to zero ($D_r$=0), in that the Inner Magnet is fixed. The following gyroscopic effects will not occur in all such cases without Mechanical Give implemented elsewhere in the design, but the Outer Magnet will still rotate as explained above.

Figure 6:
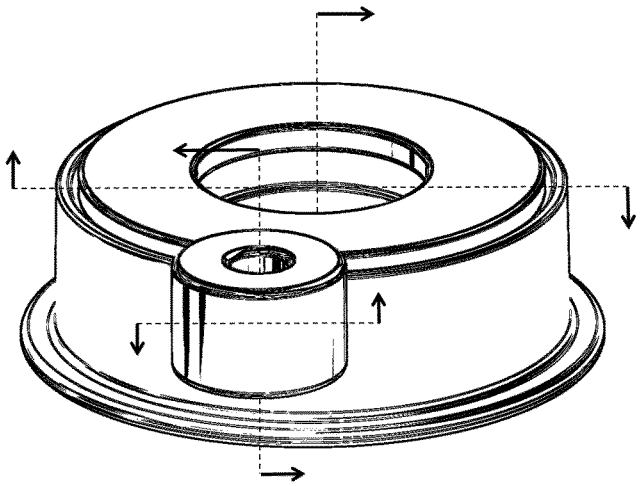
FIG. 6 shows magnet torsion.

In most conditions and applications, Mechanical Force causes the axes of the Inner Magnet and Outer Magnet to co-twist (torque) if not prevented from doing so mechanically or structurally (Mechanical Give)—even if but one degree or less off-parallel between the Inner Magnet and Outer Magnet's respective axes of symmetry, which is an additional Axis-Alignment Force $F_l$. When $F_u>F_a>F_l$ the Outer Magnet is permitted to orbit the Inner Magnet more than ninety degrees before than the Inner Magnet is able to realign its axis parallel to the Outer Magnet. The result is a counter-twist (torsion) between the Inner Magnet and the Outer Magnet during the next ninety degrees of the Outer Magnet's orbit, which induces a precessional cycle occurring every one hundred eighty degrees (thus, twice the rate of the Outer Orbit frequency) as shown in FIG. 6.

It can be determined that in an environment of reduced gravity (outside the Earth's atmosphere for instance), when applying Mechanical Force $F_a$ perfectly in line with the Outer Orbit, precession of the Inner Magnet will not result even with Mechanical Give implemented. However, reduced gravity applications of the mechanism are still possible so long as gravity alone is not relied on for offsetting the line of Mechanical Force and the direction of Outer Orbit.

As the axes tend to reorient themselves, the result is a gyroscopic effect; the configuration tends to remain in a fixed reference plane in the predicted manner of known gyroscope physics until the rotations cease.

Said inverted-gyroscopic effect causes the Inner Magnet to precess as the four rotations occur.

All standard gyroscopic effects are present and definable in this mechanism, with the exception of maintaining equilibrium, which becomes destabilized due to the gyroscopes' inverted state.

Figure 7:
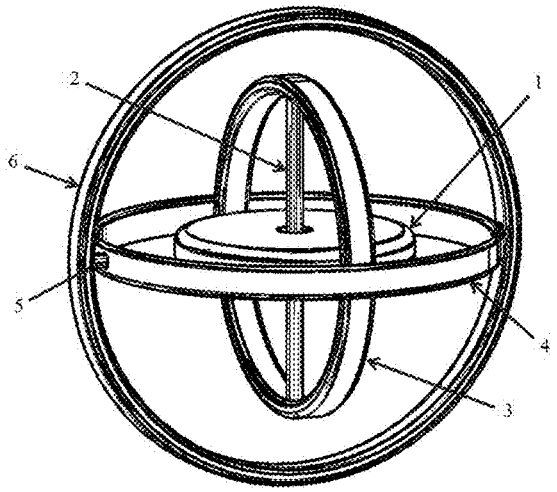
FIG. 7 shows a prior art common gyroscope.

The Inner magnet of this invention becomes equivalent to the "Precess Gimbal", the Outer Magnet equivalent to the "Flywheel" and the cylinder Spacer equivalent to the "Gyroscope Frame". All other standard components of a gyroscope, as shown in FIG. 7, (where the parts are identified as 1) Flywheel spins on 2) Axle, which rolls or resists against 3) Output Gimbal, which may be fixed or freely to 4) Precess Gimbal, which is attached to 5) a pin or rod that rolls, slides or resists a groove in the 6) the gyroscope frame) are fulfilled by the magnetic fields or other optional structural components implementing Mechanical Give.

However, because the Precess Gimbal (Inner Magnet) of this invention resides inside the Gyroscope Frame (the cylinder Spacer) instead of between the Gyroscope Frame and the Flywheel, and the Flywheel (Outer Magnet) resides outside the Gyroscope Frame, the result is that when in operation the precession frequency repeats at a higher rate than the Flywheel rotation frequency and the Flywheel rotation frequency repeats at a higher rate than the Precess Gimbal frequency.

In terms of the existing gyroscopic exercise products/patents that influence an increased rate of Flywheel rotation by means of applied precession, a restriction of operation exists that the relative speed of the surface of the Axle and the side of the Groove in the Gyroscope Frame due to precession, $\Omega_p R_{groove}$, must exceed the relative speed due to the rotation of the spinning mass, $\omega r_{axle}$, in order to speed up the spin of the Flywheel. The minimum torque required to meet this condition is $$\tau_{min} = I\omega^2\left(\frac{r_{axle}}{R_{groove}}\right),$$

where I is the moment of inertia of the spinning mass, and ω is its angular velocity.

In this invention, however, this condition is met by its very nature, through geometric and magnetic constraints, and any amount of movement on the Flywheel induces counter-rotation, torque and torsion of the Precess Gimble.

Precession and torsion is the effect generated from this invention, not that which is applied. It may be considered the inverse mechanism of a common gyroscope, containing all the same variables, but with dissimilar output effects.

Figure 8A:
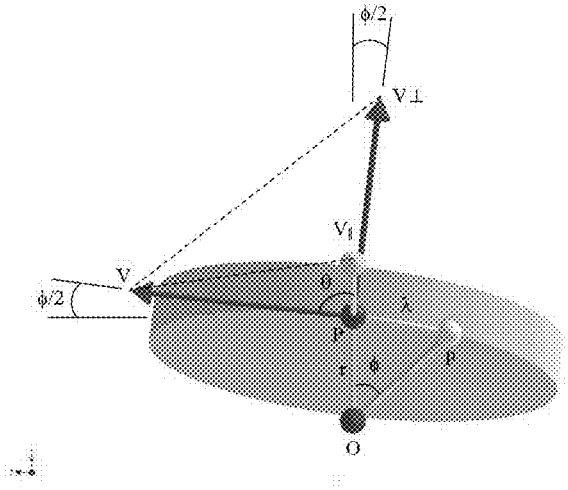
FIGS. 8*a, b* and *c* show velocity vectors on the inner magnet.
Figure 8B:
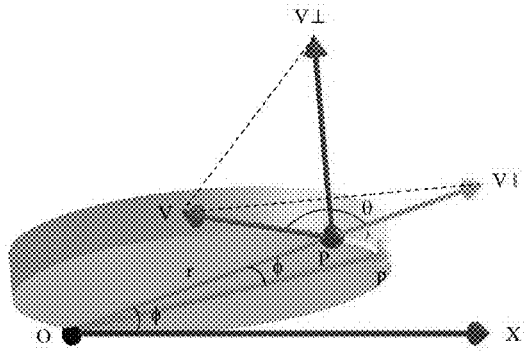
Figure 8C:
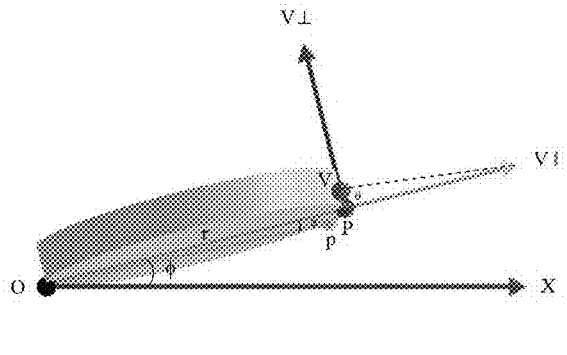

The ratio of the rotation frequency of the Outer Magnet around the outside of the cylinder to the rotation frequency of the Inner Magnet around the inside of the cylinder ($D_r$) can be calculated by $$D_r = \frac{f_0}{f_I} = \frac{2kuA_{IM}}{A_{ID} - A_{IM}},$$

where k is in many cases simply the value one and u is the unitary vector over the Instantaneous Rotation Axis. u is equal to either side of equation $\omega|r|/(|V|\sin(\theta)=\theta/\phi$. r in this case is the diameter of the Inner Magnet and not the radius, and V is the three dimensional angular velocity that occurs in this mechanism. θ symbolizes the angle in radians between the direction of the parallel velocity and the three dimensional angular velocity, and ϕ is the angle representing how much a point on the circumference of the Inner magnet is offset in one precessional oscillation. $A_{IM}$ is the surface area of the magnet and $A_{ID}$ is the surface area of the inside of the Cylinder Spacer as shown in FIGS. 8*a, b*, and *c*.

Because θ,ϕ are determined by the geometries of the Inner Magnet and the cylinder Spacer, that which limits the angles, it does not make any difference on $D_r$ how fast or slow the Flywheel rotates; the ratio of the two frequencies remains independent from velocity. The ratio of frequencies may be roughly one to five (Inner Magnet to Outer Magnet) with a difference of only one quarter inch or so between the diameter of the Inner Magnet and the diameter of the Cylinder Spacer, but approaches one to sixty or more with a difference in diameters of only one thirty-secondth of an inch or less.

This mechanism may have applications in exercise and therapy industries for building and/or strengthening muscles when the Mechanical Force is muscular and is different from existing gyroscopic exercising tools in that the rotating mass in this configuration is on the outside of the Gyroscopic Frame, while the rotating mass in the existing patents is on the inside.

Since the applied force is linear, the mechanism may be used in varied directions (horizontally, vertically or to an angle), which is not practical with the previous prior art mechanisms; the existing mechanisms require the individual to apply precessional motion throughout the exercise, which limits or eliminates linear directional exercises.

Because the mechanism described in this patent application does require applied precessional torque from the wrist, hand and forearm, risk of joint and nerve damage may be reduced.

Following the applied push, due to angular momentum, the recoil effect is itself precessional (as opposed to the applied force being processional), which may be beneficial to loosening tight muscles and joints, as well as increasing blood flow, as it is the reaction to the Mechanical Force and not the action.

This mechanism can also be constructed into apparatuses that may be held with two hands to be used to exercise neck and shoulder muscles, which is not as practical with the existing prior art mechanisms.

This invention is virtually self-starting and does not require a rip-cord or other mechanism to generate spin of the Flywheel.

Because the Outer Magnet may be additionally weighted and it resides outside the Spacer, merely tilting the apparatus starts its roll, beginning the rotation. In order to maintain rotation, successive linear pushes or pulls, $F_a$, are applied.

Because the Outer Magnet of this mechanism rolls liberally, the minimum Resistive Force $F_r$ can be considerably less than that of existing gyroscopic mechanisms and can even be lubricated and still work effectively in order to aid in the reduction of wear on structural materials. Existing gyroscopic mechanisms that require friction to increase the speed at which the Flywheel spins cannot be lubricated and still function properly, and therefore need to be routinely opened and cleaned to remove debris from the grooves; this mechanism can be permanently encased.

The gyroscopic effects due to the Inner Magnetic precession become evident by comparing the aforementioned configuration with the identical, save instead having a fixed Inner Magnet, which eliminates precession and therefore all gyroscopic effects.

Figure 9:
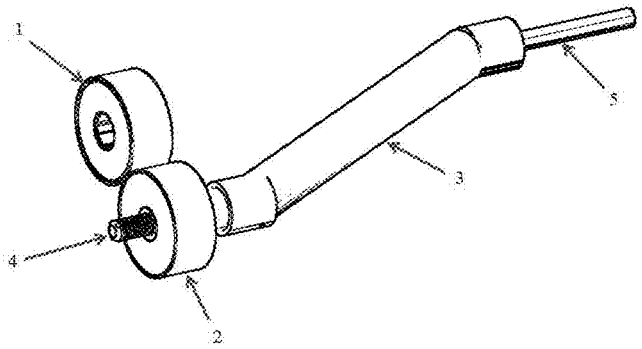
FIG. 9 shows use of the embodiment with a CV joint.

Because the mechanism allows for use of ring magnets and other structural components, CV joints or other applications of mechanical advantage may be used to rotate coils or more magnets by merely pushing the device back and forth as shown in FIG. 9 (where the parts are identified as: 1) Inner Magnet, 2) Outer Magnet, 3) CV Joint, 4) output axle and 5) input axle.

Figure 10A:
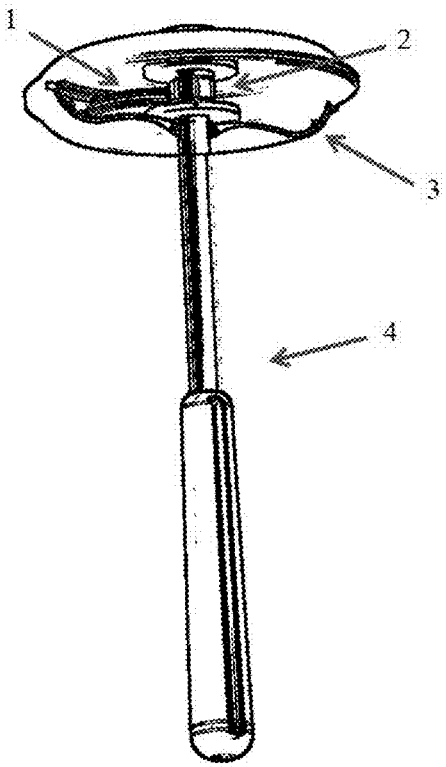
FIGS. 10*a* and *b* show views of an alternative embodiments.
Figure 10B:
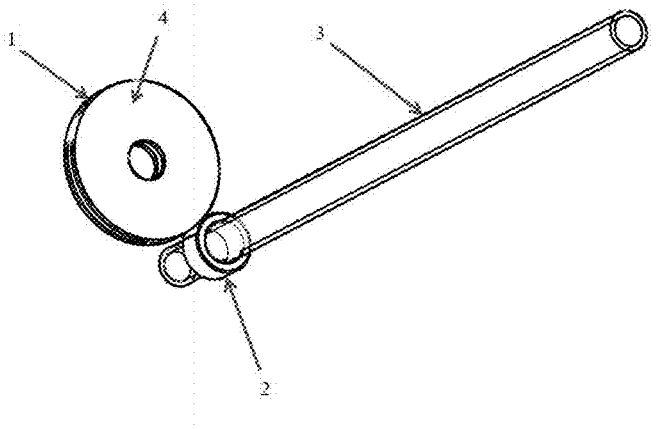

The same effects for exercise products may, however, be obtained with a fixed Inner Magnet when it is placed on a semi-flexible rod (hollow graphite, plastic or similar) as shown in FIGS. 10*a* and 10*b* (where the parts are identified as: 10*a:* 1) Outer Magnet, 2) fixed Inner Magnet, 3) enclosure and 4) semi-flexible or pivotable handle, and 10*b;* 1) Outer Magnet, 2) fixed Inner Magnet, 3) semi-flexible or pivotable handle and 4) weights.) In such cases, the rod tends to bow, allowing for the precessional component.

In the configuration of a fixed Inner Magnet on a semi-flexible rod handle, the rod itself becomes the Mechanical Give that allows for the precessional motion.

The Outer Magnet may be larger or smaller than the Inner Magnet and can be weighted in order to amplify and/or vary the quality of the gyroscopic effects.

The semi-flexible rod handle need not require a fixed Inner Magnet and could be implemented for additional Mechanical Give purposes alone.

Figure 11:
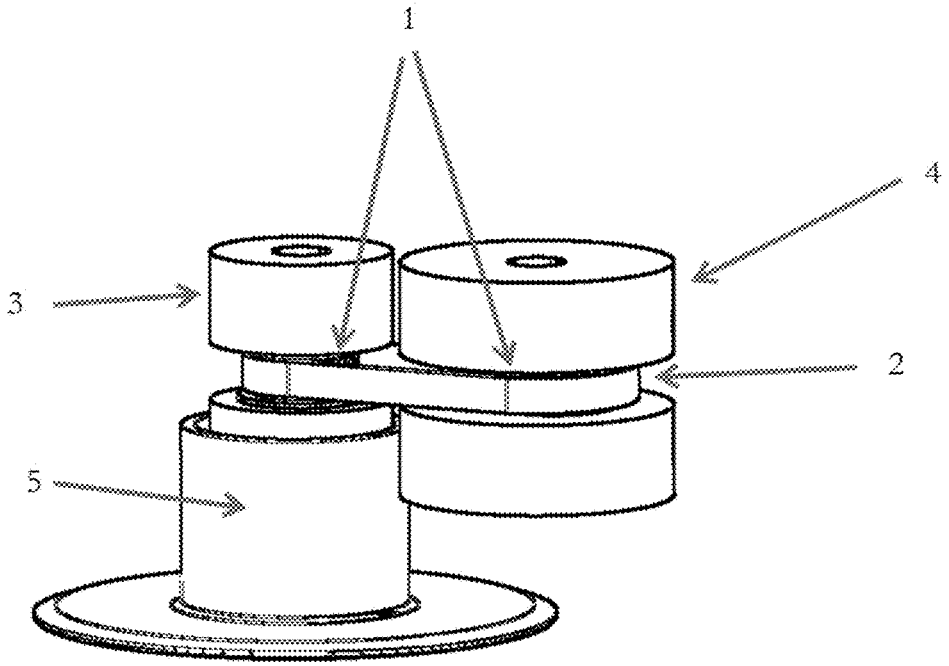
FIG. 11 shows an alternative to magnets, using belts and bearings.

Round magnets may be replaced altogether with non-magnetic alternatives, so long as each of the conditions described throughout these descriptions are met. One alternative means may be to implement bearings, belt/s and non-magnetic weights, as shown in FIG. 11. In this alternative 1) bearings spin freely on their axis to allow 2) a belt to acts replace magnetic attraction (keeping the rollers attached to each other) and whose twist (torsion) is determined by the width or material property or placement around 3) a non-ferrous round inner roller and 4) a non-ferrous round outer roller, separated by 5) a cylinder Spacer that allows the belt to pass freely around the center coordinate.

The scope of these example practical applications are in no way to be considered the limit of possible applications, but rather are added to better illustrate this invention's claims.

What is claimed is:

1. A device having pair of roller magnets configured such that the device resists orientation when the roller magnets are kept in a continuous twisting and counter-rotating motion by repeated movements of the device comprising:

a right curvilinear shaped inner magnetic roller having a base and a circular radius;

a right curvilinear shaped outer magnetic roller having a base and a circular radius; and, said inner magnetic roller and said outer magnetic roller magnetically attached tangentially and parallel to said inner magnetic roller's and said outer magnetic roller's polar axes of symmetry;

said inner magnetic roller's pole and said outer magnetic roller's pole aligned facing opposite to each other;

said inner magnetic roller's rotational circumference being less than said outer magnetic roller's rotational circumference;

said device being subjected to a repeating movement causing said inner magnetic roller and outer magnetic roller to twist and counter-rotate against each other; and, a holder means for restricting said inner magnetic roller and outer magnetic roller from folding towards each other more than ninety degrees while allowing both said inner magnetic roller and said outer magnetic roller to twist and counter-rotate.

2. A device having pair of rollers configured such that the device resists orientation when the rollers are kept in a continuous twisting and counter-rotating motion by repeated movements of the device comprising:

a right curvilinear shaped inner roller having a base and a circular radius;

a right curvilinear shaped outer roller having a base and a circular radius; and, said inner roller and said outer roller flexibly mechanically attached tangentially and parallel to said inner roller's and said outer roller's polar axes of symmetry;

said inner roller's rotational circumference being less than said outer roller's rotational circumference;

said device being subjected to a repeating movement causing said inner roller and outer roller to twist and counter-rotate against each other; and, a holder means restricting said inner roller and outer roller from folding towards each other more than ninety degrees and allowing both said inner roller and said outer roller to twist and counter-rotate.

* * * * *